United States Patent [19]

Stevens

[11] 4,147,608

[45] Apr. 3, 1979

[54] IMPRESSED CURRENT CATHODIC PROTECTION

[75] Inventor: John E. Stevens, Betchworth, England

[73] Assignee: F. A. Hughes and Co., Ltd., Surrey, England

[21] Appl. No.: 836,543

[22] Filed: Sep. 26, 1977

[30] Foreign Application Priority Data

Jun. 28, 1977 [GB] United Kingdom ..... 27009/77

[51] Int. Cl.[2] ..... C23F 13/00

[52] U.S. Cl. ..... 204/196; 307/95

[58] Field of Search ..... 204/197, 196

[56] References Cited

U.S. PATENT DOCUMENTS

| | | | |
|---|---|---|---|
| 2,982,714 | 5/1961 | Sabins | 204/196 |
| 2,987,461 | 6/1961 | Sabins | 204/196 |
| 2,998,371 | 8/1961 | Sabins | 204/196 |
| 3,127,337 | 3/1964 | Conger et al. | 204/196 |
| 3,622,489 | 11/1971 | Dumitresur | 204/196 |

*Primary Examiner*—Howard S. Williams

*Attorney, Agent, or Firm*—Lewis H. Eslinger

[57] ABSTRACT

An impressed current cathodic protection apparatus has an electromechanically actuated variable transformer providing a variable output voltage and shunt-connected current monitors to monitor the impressed current and to vary the transformer turns ratio to maintain the impressed current within a predetermined range of values.

11 Claims, 3 Drawing Figures

1a
20
21
22
23
24
25
26
30
31
32
2
1
3
5
6
7
8
9
10
11
12
13
14
15
16
17
18
T1
T2
T3
T4
T1:1
T2:1
T3:1
T4:1

IMPRESSED CURRENT CATHODIC PROTECTION

The present invention relates to the protection of structures from corrosion by the use of cathodic protection and, more particularly, to apparatus for, and methods of impressed current cathodic protection.

Corrosion is essentially an electrochemical phenomenon and cathodic protection is a commonly used method of combatting it. Broadly, there are two methods of cathodic protection: firstly the method in which a sacrificial anode is used and is corroded instead of the structure to be protected; and secondly, the "impressed current" method in which a direct electrical current is caused to flow from one or more inert anodes through the ground or liquid around a buried or immersed metallic structure into the surface of the structure. One important advantage of the latter method is that the protecting anodes are only corroded very slowly, if at all, and this avoids the need for their frequent replacement.

In the impressed current method, the value of the current used is important since too small a value may allow the corrosion to continue (even though at a reduced rate) while too large a current is wasteful of electrical energy and may disturb any paint coating on the surface of the structure. In order to facilitate control of the impressed current, the effect of the impressed current can be measured by means of one or more "reference electrodes" buried or immersed in the vicinity of the structure, the potential difference between the reference electrode and the structure being measured by means of a millivoltmeter so that an operator can judge whether the impressed current is within the correct range of values or too high or too low.

Automatically operating cathodic protection systems are now in common use. These systems make use of one or more reference electrodes made of materials or combinations of materials providing an adequately stable reference with respect to which the varying potential difference at the structure may be measured and the signal from the reference electrode is, after amplification, used to actuate a device which appropriately varies the direct impressed current which is delivered from the output of a transformer/rectifier combination. This direct current output is passed into the ground or liquid via anodes which may, for example, be made from platinised titanium, lead, silver, graphite, silicon iron or other suitable material. The direct current passes through the ground or liquid to the buried or immersed surface of the structure and the system operates to maintain the impressed current at a value appropriate to the particular circumstances. For example factors which affect the correct value of impressed current in the case of a ship include the speed of the ship, its draught, water salinity and temperature and type and condition of paint coating.

The circuitry required to achieve control of the impressed current includes devices such as saturable reactors, thyristors or triacs which actually control the value of the impressed current, as well as a suitable amplifier for amplifying the signal from the reference electrode. There are a number of disadvantages associated with the control systems currently in use, these including:

1. their sensitivity to, and liability to damage by high value transients in the AC supply voltage;

2. high cost because of the use of massive wire wound components or sophisticated semi-conductor devices;

3. great weight and/or large volume resulting from the use of large wire wound components and/or the need for extensive heat sinks;

4. the difficulty of providing an inexpensive manual override for the control system; and 5. the need for skilled and specialised attention during servicing or breakdown rather than the more commonly available conventional electrical engineering knowledge. This latter disadvantage is particularly important where the protection system is used, for example, on boats, ships or barges where in the event of a breakdown there could well be nobody on board having sufficient knowledge to be able to repair the system; equally the repair of a control system in which the impressed current is regulated by semi-conductor devices requires specialised tools for its repair.

According to the present invention we provide an apparatus for impressed current cathodic protection of a structure, comprising a variable transformer for providing, via a rectifying circuit, the impressed current to at least one anode, an electro-mechanical actuator for adjusting the output voltage of the transformer and a control circuit for connection to a reference electrode and arranged to operate the actuator in a manner to maintain, in use, the voltage at the reference electrode within a predetermined range of values. The invention can thus provide a cathodic protection apparatus which can be readily repaired or operated by a person without specialised knowledge of semi-conductor circuitry and without the need for specialised tools. The use of a variable transformer can also avoid the need to use extensive heat-sinking. Also, in view of the electro-mechanical nature of the control of the current, the apparatus is largely insensitive to the high voltage transients which can cause malfunction of semi-conductor based devices.

Suitably, the actuator is an electric motor connected to the variable transformer via a reduction gear. It is possible in a relatively simple manner then to provide for a manual override of the control circuit by providing, for example, a handle for manually operating the output shaft of the reduction gear.

The invention also provides a method of preparing a structure for impressed current cathodic protection comprising providing the structure with an apparatus according to the invention and installing on the structure, if not already provided, at least one anode and at least one reference electrode.

The invention further provides a method of impressed current cathodic protection of a structure comprising operating an apparatus according to the invention and having operatively associated therewith at least one reference electrode and at least one anode in a manner to provide an impressed current within a range of values appropriate to the environmental conditions of the structure.

The invention will be further described with reference to the accompanying drawings, in which.

Figure 1:
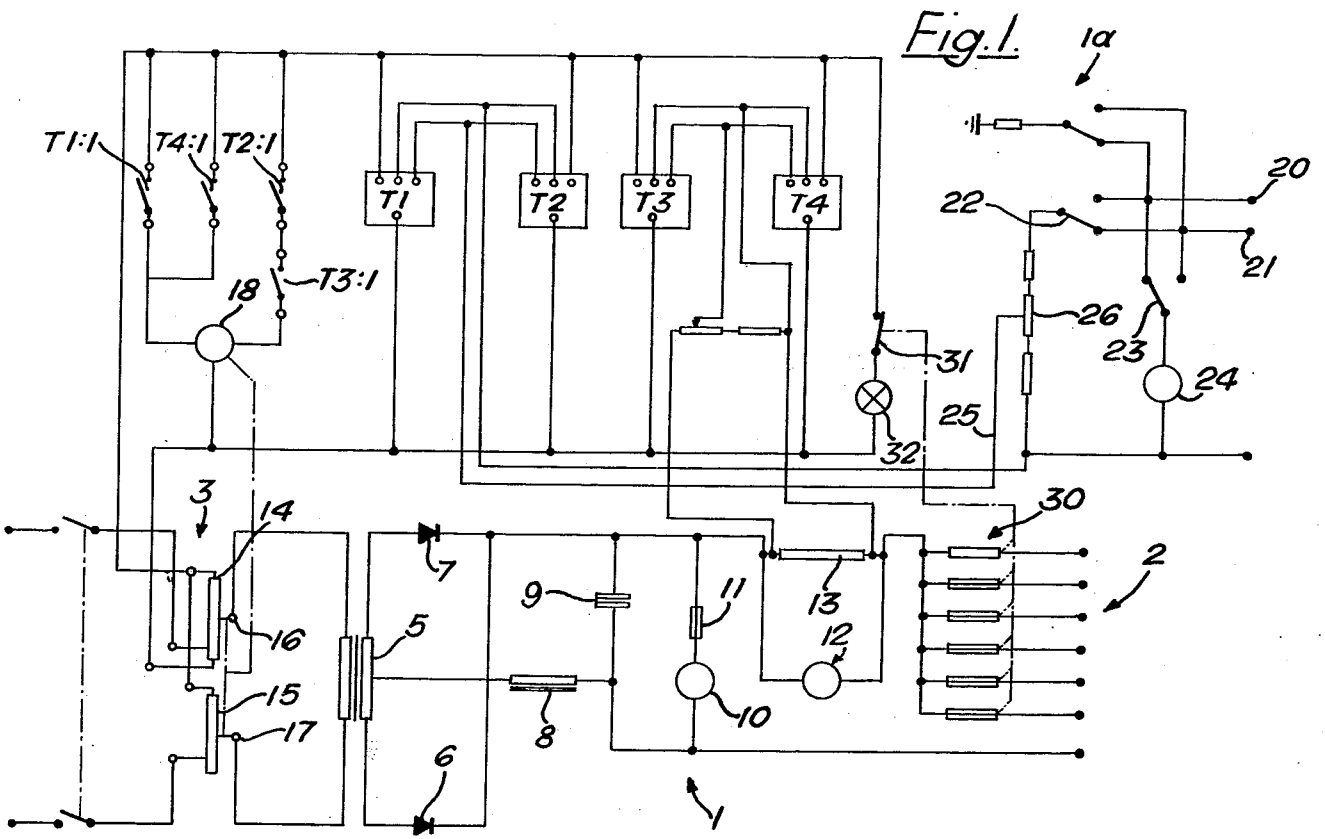
FIG. 1 is a somewhat schematic circuit diagram of an embodiment of the present invention.

In the embodiment shown in FIG. 1, a variable DC power supply generally designated 1 is connected to a single phase 415 volt alternating current supply and provides a direct voltage between a set of anodes 2 and the hull of a ship. The power supply includes a variable transformer 3, a 415 V to 20-0-20 V step-down transformer 5, whose secondary winding has a centre tap, rectifiers 6 and 7 connected to full wave rectify the output of transformer 5 and a smoothing network comprising inductor 8 and capacitor 9. A volt meter 10 having associated therewith a volt meter short circuit protection fuse 11 is connected across the DC output of the power supply to give an indication of the voltage across the anode 2 and the hull of the ship and connected in series with the lead to the anodes 2 is an ammeter 12 and associated shunt 13, the ammeter 12 providing an indication of the impressed current.

Figure 2:
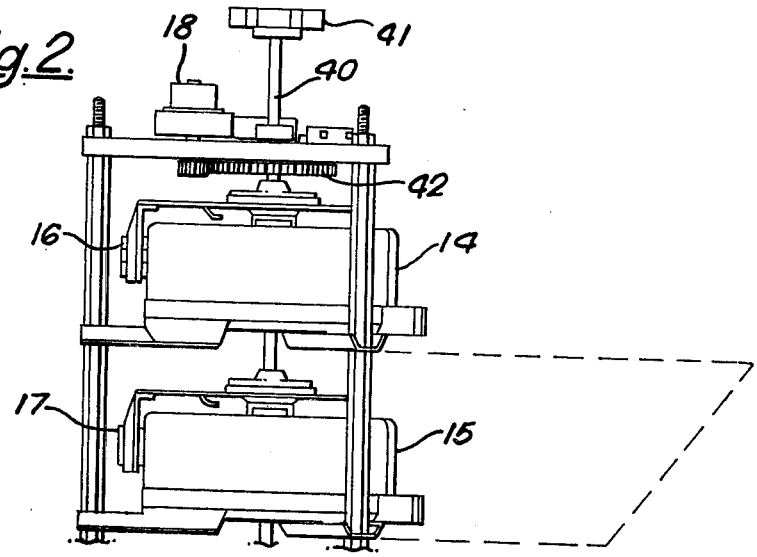
FIG. 2 is a side elevation of a motor driven transformer for use in the embodiment of FIG. 1.

The variable transformer 3 comprises two auto-transformer windings 14 and 15, the primary connections of which are series connected across the input from the alternating current supply and the variable secondary taps 16 and 17 of which are connected together to be driven by an electro-mechanical actuator in the form of a motor 18 and associated reduction gear (FIG. 2). Actuation of the motor 18 causes the secondary taps 16 and 17 of the windings 14 and 15 to be changed so that the voltage applied to the anodes 2 can be adjusted to the required value. The value of the impressed current is relatively high and so to avoid the need to use a variable transformer having a high current handling capability, the output of the auto-transformer is delivered to the step-down transformer 5 to permit an increase of the current level.

The control circuitry generally designated 1a serves to measure the effect of the impressed current and to adjust the value of the impressed current accordingly. For this purpose port and starboard reference electrodes 20 and 21 are provided on the hull of the ship, these electrodes being made of materials suitable for the purpose and providing an adequately stable reference. Thus, for example, the reference electrode could be of the copper/copper sulphate, silver/silver chloride or zinc. A user operable switch 22 is used to select whether the reference voltage from the port or starboard reference electrode is used for the automatic control of the impressed current. A separate, user-operable switch 23 is provided connected to the electrode 20 and 21 and in series with a millivolt meter 24 which provides a visual indication of the reference voltage at the selected reference electrode. Thus, an operator can obtain the information required to operate the apparatus during manual override of the automatic control circuit.

Four trip amplifiers T1, T2, T3 and T4 are provided in the automatic control circuit. The trip amplifiers T1 and T2 serve to control the impressed current so that the desired voltage as measured by the selected reference electrode is maintained while the trip amplifiers T3 and T4 are used to exert an overriding effect on the power supply to prevent its rated output being exceeded. Trip amplifiers T1 and T2 compare a signal appearing on line 25 which is representative of the reference voltage from the reference electrode selected by selector switch 22 with a respective internally generated threshold voltage and operate respective relay-type switches T1:1 and T2:1. When the voltage on line 25 is less than the threshold voltage of trip amplifier T1 the associated contacts T1:1 are caused to close, while if the voltage on line 25 exceeds the threshold value associated with the trip amplifier T2, the associated contacts T2:1 are caused to close. The trip amplifier operated switch contacts T1:1 and T2:1 are disposed in respective supply lines to the drive motor associated with the variable transformer. The switch contact T1:1 is connected to a supply input which will cause the motor 18 to rotate in a direction which will result in the voltage at the output of transformer 3, and hence the impressed current, decreasing while switch contact T2:1 is connected to a supply input of the motor 18 which will operate the motor in the direction causing the voltage at the output of transformer 3, and hence the impressed current, to increase.

The threshold of the trip amplifier T1 is slightly lower than that of the trip amplifier T2. The two threshold values may for example be derived from a common resistor network so that the threshold values will not tend to drift relative to one another. Suitably the thresholds are chosen to be one percent to each side of the desired value of the reference voltage.

The trip amplifiers T1, T2 thus define a "window" and provided the voltage on line 25 is within this window no corrective action is taken. If, however, the voltage at the selected reference electrode, and thus the voltage on line 25, decreases as to be outside the threshold window, this indicates an over protected situation in which the impressed current is too high, so the trip amplifier T1 closes its associated contact T1:1 causing the drive motor to operate the variable transformer so as to decrease its output voltage and hence the impressed current. The switch contact T1:1 will remain closed until the reference voltage is again within the window. Similarly, if the signal on line 25 increases indicating that the reference voltage has increased and that the system is now under-protected, the trip amplifier T2 will operate, closing contacts T2:1 so operating the drive motor to increase the output voltage of transformer 3 and hence increasing the impressed current.

The potential divider network comprising potentiometer 26 enables one to select the desired value of the reference voltage from the reference electrode. This makes it possible to compensate for marine environmental changes. It will be appreciated that tapping a variable proportion of the reference voltage to appear on line 25 is considerably more straightforward for this purpose than varying the threshold values of trip amplifiers T1 and T2.

Trip amplifier T3 serves to exert a current limiting function of the current supply to the anodes 2. The trip amplifier T3 detects the impressed current by monitoring the voltage across the shunt 13 associated with ammeter 12 and, when the voltage across shunt 13 exceeds an adjustable, predetermined value, trip amplifier T3 is operated opening the associated switch contact T3:1 which is in series with the switch contact T2:1. All the while trip amplifier T3 is tripped this thus prevents any further operation of the drive motor 18 in the direction to increase the impressed current. However it would still be possible under some circumstances for the impressed current to exceed the rated output of the supply 1, for example, marine environmental changes could reduce the electrical resistance through the water from the anodes 2 to the hull. In view of this possibility the trip amplifier T4 is provided and arranged to operate when the voltage across the shunt 13 exceeds a predetermined value which is suitably a few millivolts higher than that required to operate trip amplifier T3. When trip amplifier T4 is tripped, the contact switch T4:1 closes energising the motor 18 in the direction decreasing the output voltage from transformer and hence decreasing the impressed current back to the desired value.

It will be noted that in the output leads to each anode 2 is a respective fuse with an associated trip indicator and a micro-switch 31 mechanically operated by the fuse trips opens extinguishing the lamp 32 to indicate that the fuse has blown.

As shown in FIG. 2, the contact brushes associated with windings 14 and 15 of transformer 3 are coupled to a common drive 40 which is provided with a manual control knob 4 to allow an operator to exert manual control over the value of the impressed current. Motor 18 is mounted on a top plate of the assembly and drives the shaft 40 via a reduction gear 42. As is conventional in variable transformers, each winding is helically would around a respective toroidal core, through the centre of which the shaft 40 passes. The movable contact brushes such as 16, 17 are provided at the outer ends of radially extending arms carried and driven by the shaft 40 and contact the radially outwardly facing surfaces of the turns of the winding either directly or via suitable plated contact formations on the turns of the winding. Each winding and associated movable contact brush thus provides an auto-transformer having a fixed number of primary turns and a variable number of secondary turns.

Figure 3:
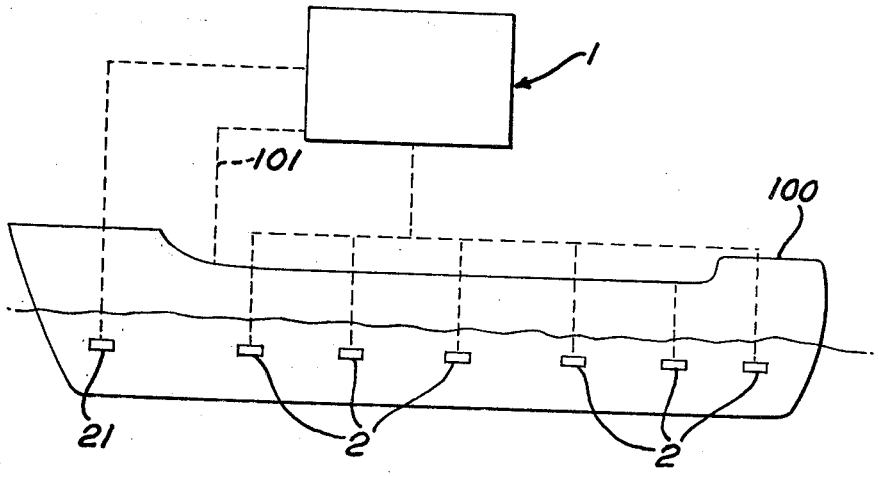
FIG. 3 is a very schematic view to show how the apparatus of FIGS. 1 and 2 is used to protect the hull of a ship.

FIG. 3 shows the apparatus of FIGS. 1 and 2 as used for impressed current cathodic protection of the hull 100 of a ship. The reference electrode 21 and the anodes 2 are suitably mounted on the outer surface of the hull 100, being insulated from the hull 100 and surrounded to the interior of the ship with suitable coffer dams to enable them to be serviced if necessary, while the ship is afloat. Suitable electrical connections are established between the reference electrode 21 and anodes 2 on the one hand and the apparatus 1 on the other, the negative side of the output of apparatus 1 being connected to the hull 100 by a conductor 101. Obviously like electrodes and anodes are mounted on the opposite sides of the hull. Once installed, the apparatus is operated as indicated above.

Although the embodiment above has been described with reference to this application to cathodic protection of a ship it will be appreciated that a wide variety of other structures can be protected using the apparatus. Thus the apparatus may be used to protect barges, boats, floating platforms, oil rigs, undersea pipelines and the like and structures buried beneath the ground such as oil and gas pipelines and underground storage tanks.

I claim:

1. An apparatus for impressed current cathodic protection of a structure, the apparatus comprising a variable transformer, a rectifying circuit for rectifying the output of the variable transformer to produce the impressed current at least one anode connected to receive the impressed current, an electro-mechanical actuator operatively coupled to the variable transformer for adjusting the output voltage thereof, a reference electrode and a control circuit connected to the reference electrode and arranged to operate the actuator in a manner to maintain, in use, the voltage at the reference electrode within a predetermined range of values.

2. An apparatus according to claim 1, wherein the variable transformer has a primary section for connection to an electrical supply and a secondary section, and the apparatus further comprises a voltage-step-down transformer having a primary connected to the secondary section of the variable transformer and a secondary connected to said rectifying circuit.

3. An apparatus according to claim 1, and including first and second threshold switches arranged to operate the actuator when, in use, the voltage at the reference electrode is greater than, or less than, respectively, thresholds associated with said switches.

4. An apparatus according to claim 3, wherein each threshold switch is arranged to compare the voltage at the reference electrode with a predetermined voltage.

5. An apparatus according to claim 4, further comprising a common source of said predetermined voltage for each threshold switch.

6. An apparatus according to claim 3, wherein a circuit is provided to deliver an adjustable proportion of the voltage at the reference electrode to said threshold switches.

7. An apparatus according to claim 1, wherein a circuit is provided to monitor the impressed current and is operative, when the impressed current exceeds a predetermined value, to prevent the actuator from being operated so as to increase the impressed current.

8. An apparatus according to claim 1, wherein a circuit is provided to monitor the impressed current and is operative, when the impressed current exceeds a predetermined value, to operate the actuator so as to reduce the impressed current.

9. An apparatus according to claim 1, wherein the variable transformer has a shaft which is rotatable by means of the actuator to vary the turns ratio and the actuator comprises an electric motor and gear means connecting the shaft and motor, the shaft being manually rotatable to enable the turns ratio to be adjusted by hand.

10. An apparatus according to claim 1, wherein the variable transformer comprises a plurality of helical turns disposed in a toroidal configuration and a wiper to contact the turns to provide variability of the transformer turns ratio.

11. An apparatus according to claim 1, wherein the variable transformer is wound in an auto-transformer configuration.

* * * * *